US006369304B1

(12) United States Patent
Tucker

(10) Patent No.: US 6,369,304 B1
(45) Date of Patent: Apr. 9, 2002

(54) SELECTED PERCUSSION ADDITIONS FOR STRINGED MUSICAL INSTRUMENTS

(76) Inventor: Nancy Tucker, 185 Burton Rd., Beacon Falls, CT (US) 06403

( * ) Notice: Subject to any disclaimer, the term of this patent is extended or adjusted under 35 U.S.C. 154(b) by 0 days.

(21) Appl. No.: 09/813,181

(22) Filed: Mar. 20, 2001

(51) Int. Cl.[7] ..... G10D 3/00

(52) U.S. Cl. ..... 84/291; 84/267; 84/290; 84/411 R

(58) Field of Search ..... 84/291, 267, 294, 84/420, 290, 411 R

(56) References Cited

U.S. PATENT DOCUMENTS

| | | | | |
|---|---|---|---|---|
| 134,679 A | | 1/1873 | Knaffl | |
| 398,176 A | | 2/1889 | Oerlein | |
| 1,346,013 A | * | 7/1920 | Galbraith | 84/294 |
| 2,033,826 A | | 3/1936 | Haium | 84/173 |
| 3,375,747 A | | 4/1968 | Posey | 84/453 |
| 3,680,423 A | | 8/1972 | Lander | 84/170 |
| 3,743,751 A | | 7/1973 | Ibanez | 84/1.16 |
| 4,024,788 A | * | 5/1977 | Dunlap | 84/267 |
| 5,841,052 A | * | 11/1998 | Stanton | 84/600 |
| 5,900,573 A | | 5/1999 | Barnes | 84/746 |

FOREIGN PATENT DOCUMENTS

| | | |
|---|---|---|
| WO | WO 87/02169 | 4/1987 |

* cited by examiner

*Primary Examiner*—Shih-Yung Hsieh
(74) *Attorney, Agent, or Firm*—Wiggin & Dana; Jody Lynn DeStefanis; Williiam A. Simons

(57) ABSTRACT

One embodiment of the present invention is a percussion addition for a stringed instrument, such as a guitar, comprised of a hollow disc with a face, and a hollow support adapted for connection to an off-set sound hole in a stringed instrument. The percussion addition may be provided as a kit with interchangeable percussion additions. Alternatively, the kit may include percussion additions with the discs that are removable from the support and allow different discs to be received by the same support. Further, this invention includes a combination stringed and percussion instrument comprised of a stringed instrument with one or more percussion additions affixed to select off-set sound holes.

20 Claims, 4 Drawing Sheets

SELECTED PERCUSSION ADDITIONS FOR STRINGED MUSICAL INSTRUMENTS

BACKGROUND OF THE INVENTION

1. Field of the Invention

This invention relates to the addition of percussion to a stringed musical instrument, and more particularly, to the use of percussion additions placed in select off-set sound holes of a stringed musical instrument, such as a guitar, for the purpose of adding percussion.

2. Description of the Related Art

A growing trend of guitarists is to slap the strings (slap bass) or the body of the guitar to add percussion to their music, such as during performances. However, this slapping does not adequately simulate the sound of a true percussion instrument. To create a more realistic percussion sound, some musicians place various pick-ups in the body of the guitar. For example, some musicians modify ADAMAS® Smooth Top guitars manufactured by Kaman Corporation of Bloomfield, Conn. to receive Seymour Duncan® contact pick-ups manufactured by Carter Duncan Corporation doing business as the Seymour Duncan Pickups Corporation, both of Santa Barbara, Calif., so that percussion music created by tapping the body of the guitar is better heard during performances.

While the benefit of adding percussion sounds to guitars or other stringed musical instruments has been known for many years, the prior art does not disclose an apparatus that is easily adapted to modern guitars, is useful for the manual creation of music, and allows improvisational music.

For example, U.S. Pat. No. 398,176 introduces percussion sounds to a banjo by affixing spring arms to a bracket that in turn is affixed to the banjo frame. Further, this patent discloses that weights or beaters are beat against the spring arms to create the drum-like sound.

U.S. Pat. No. 2,033,826 discloses a stringed instrument with the addition of percussion. The unique stringed instrument is a pitchfork with piano wire running along the shaft. Attached to the foot of the shaft is a percussion addition in the form of a large hollow can with a foot-operated drum pedal.

U.S. Pat. No. 3,375,747 discloses a rhythm beating attachment for guitars. This attachment contains a plurality of parallel ridges that may be strummed to create a rhythmical monotone beat or an accented beat at the end of each downstroke of the guitar strings.

U.S. Pat. No. 3,680,423 discloses a combination drum and guitar musical instrument. This instrument includes a guitar body with an elongated foot piece extending to floor. Attached to the foot piece is a drum with a foot-operated drum pedal.

U.S. Pat. No. 3,743,751 discloses a guitar with an electronic drum sound effects unit affixed to the guitar.

U.S. Pat. No. 5,900,573 discloses a percussion addition to a guitar. The percussion addition includes a foot-operated mechanical actuation device that is triggered by a mechanical or electrical pulse.

The above-referenced prior art documents are incorporated by reference herein in their entirety.

A drawback of these inventions is that they are not easily adapted to modern guitars. Further, many of these percussion additions are not operated by improvisational tapping on the surface of the guitar and do not create a realistic drum effect.

BRIEF SUMMARY OF THE INVENTION

Therefore, an object of the present invention is to provide a percussion addition that is easily adapted to solid or hollow bodied stringed musical instruments, such as a guitar.

Another object is to provide a percussion addition to manually create a percussion sound, preferably a drum sound, with a stringed musical instrument.

One embodiment of the present invention is a percussion addition comprised of a percussion addition for a stringed instrument comprised of a hollow disc with a face or drumhead, wherein said disc has a hollow support such that said hollow disc and said hollow support form a continuous hollow space and wherein said support is adapted for connection to an off-set sound hole in a stringed instrument. For the purpose of this application, off-set sound holes include traditional off-set sound holes, such as those on an OVATION® Celebrity Deluxe guitar manufactured by Kaman Corporation of Bloomfield, Conn., as well as F-sound holes, such as those on a HAMER® $25^{th}$ Anniversary guitar also manufactured by Kaman Corporation. The term "off-set sound holes" means any sound hole except the center hole (i.e., those holes in the instrument over which strings pass). These off-set sound holes may be originally manufactured in the instrument or may be specifically added to the instrument for the purpose of receiving the percussion addition. In addition, the off-set sound hole may be positioned anywhere on the body of the instrument; it is not necessary that the off-set sound hole be placed on the soundboard of the instrument body.

Preferably, the percussion addition is placed in an existing sound hole in the guitar and most preferably it is placed in an existing off-set hole. Preferably, the stringed musical instrument is a hollow bodied instrument, such as a guitar, and most preferably it is an ADAMAS® guitar with multiple off-set sound holes and a carbon fiber soundboard, such as an ADAMAS® Smooth Top.

A second embodiment of the present invention is a percussion addition kit comprised of more than one percussion addition, wherein each percussion addition has a different percussion sound so that a musician can interchange percussion additions on a stringed instrument to create a variety of percussion additions and wherein said percussion additions are comprised of a hollow disc with a face or drumhead, wherein said disc has a hollow support such that said hollow disc and said hollow support form a continuous hollow space and wherein said support is adapted for connection to selected off-set sound holes in a stringed musical instrument. The kit may optionally include one or more amplification devices, such as microphones or contact pick-up. Each percussion addition is different so as to create different percussion sound so that the musician may create a variety of percussion sounds during performances.

A third embodiment is a percussion addition kit comprised of more than one percussion addition, wherein each percussion addition has a different percussion sound so that a musician can interchange percussion additions on a stringed instrument to create a variety of percussion additions and wherein said percussion additions are comprised of a hollow disc with a face, wherein said disc has a hollow support such that said hollow disc and said hollow support form a continuous hollow space and wherein said hollow disc is removable from said hollow support, and wherein said kit further includes one or more different discs interchangeable with said removable disc. Again, the percussion additions, more specifically the hollow discs, are different to allow the musician to create a variety of percussion sounds.

The hollow discs are removable from the hollow support to allow the musician to interchange the disc during performances and create a variety of percussion sounds. These kits may optionally include one or more amplification devices.

A fourth embodiment is a combination stringed and percussion instrument comprised of a stringed instrument with one or more off-set sound holes and one or more percussion additions of described above affixed to selected of said one or more off-set sound holes. Preferably, the instrument is a hollow bodied guitar with off-set sound holes. Optionally, the instrument may include one or more amplification devices positioned in said hollow discs.

The details of one or more embodiments of the invention are set forth in the accompanying drawings and the description below. Other features, objects and advantages of the invention will be apparent from the description and drawings, and from the claims.

BRIEF DESCRIPTION OF THE SEVERAL VIEWS OF THE DRAWINGS

Like reference numbers and designations in the various drawings indicated like elements.

DETAILED DESCRIPTION OF THE INVENTION

The present invention teaches the use of percussion additions that may be removably connected or fixedly attached to sound holes in the body of a stringed instrument, preferably a hollow bodied stringed instrument. Non-limiting examples of acceptable hollow and solid body instruments include a six or twelve string guitar, hollow or solid body electric guitar, bass guitar, Chapman Stick® manufactured by Stick Enterprises, Inc., of Woodland Hills, Calif., banjo, National Resonator guitar (such as a Dobro® guitar manufactured by Gibson Guitar Corporation of Nashville, Tenn., mandolin, ukulele, violin, double bass, or harp. These percussion additions create a tapping surface for the production of percussion music. For the purposes of this application, percussion shall mean the sound and/or vibration created when two objects impact.

For the purposes of this patent application, the term "center hole" shall refer to a sound hole, generally in the center of the soundboard of the instrument, over which the strings pass. As stated above, off-set sound holes refer to all sound holes except the center hole. Thus, for the purpose of this application, off-set sound holes include traditional off-set sound holes as well as F-sound holes, either existing in the instrument or added to the instrument. Further, off-set sound holes may be located anywhere on the body of the instrument and is not intended to be limited to the soundboard of the instrument body.

For the purpose of this patent application, "body" shall include all surfaces of the guitar and is not limited to the soundboard.

Figure 1:
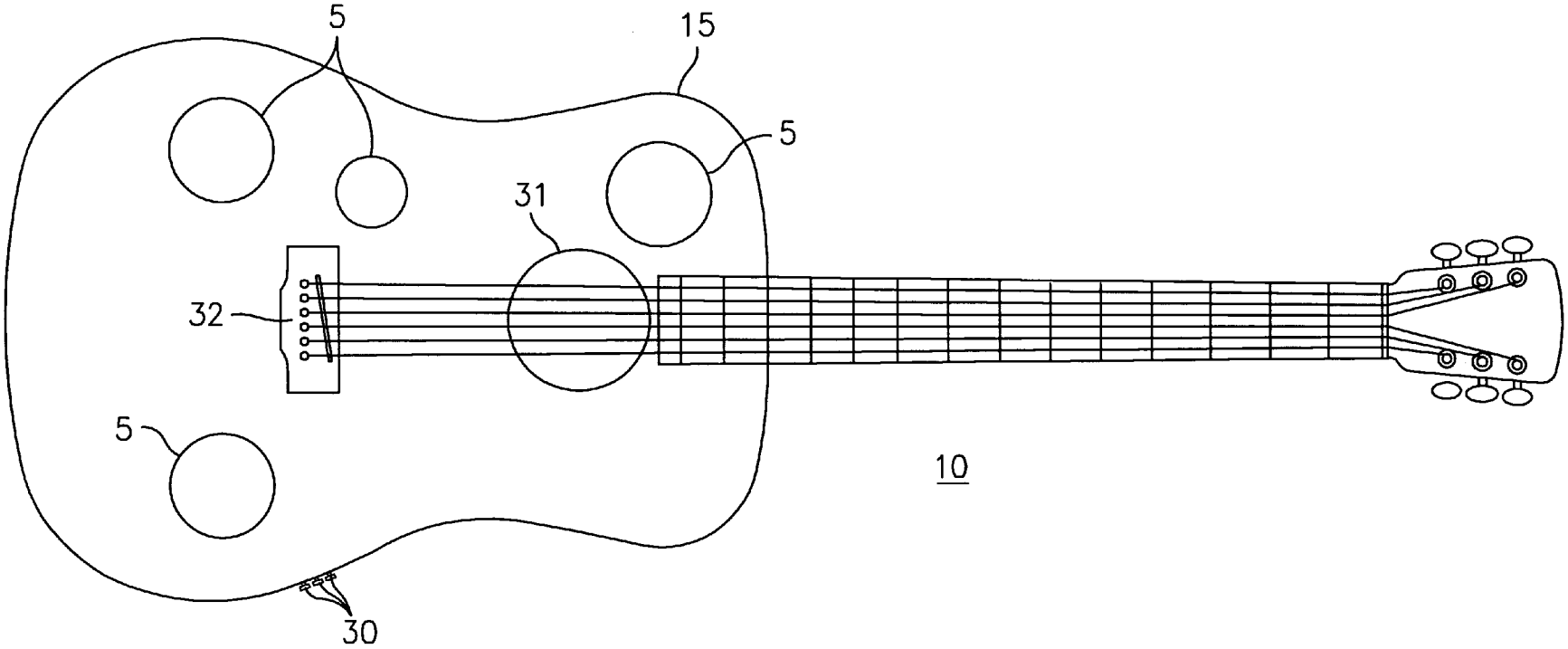
FIG. 1 is a diagram of a guitar with off-set sound holes.

FIG. 1 shows a guitar 10 having a body 15 with a center hole 31, four (4) off-set sound holes 5, and a bridge 32. Also shown are jacks 30 for connection to various amplification devices. While a guitar is depicted herein, one skilled in the art would recognize that other stringed instruments may be easily adapted to receive the percussion additions, such as a double bass. Further, while any guitar may be adapted to receive these percussion additions, guitars with off-set sound holes are preferred. Examples of preferred stringed musical instruments are OVATION® guitars, such as OVATION® Collectors Edition, Custom Elite (CE778, CE868), Elite (1778, 1868, 1858, L778), Elite Special (S778, S868), Celebrity Deluxe (CS245, CS257), and Specialty (CC074, B778, 6773, 6774, DS778, DCS247S, MC868, MM68, MCS148, EA68, EA63, C468, CS212, CC012) guitars. Most preferable are ADAMAS® Smooth Top guitars.

Figure 2:
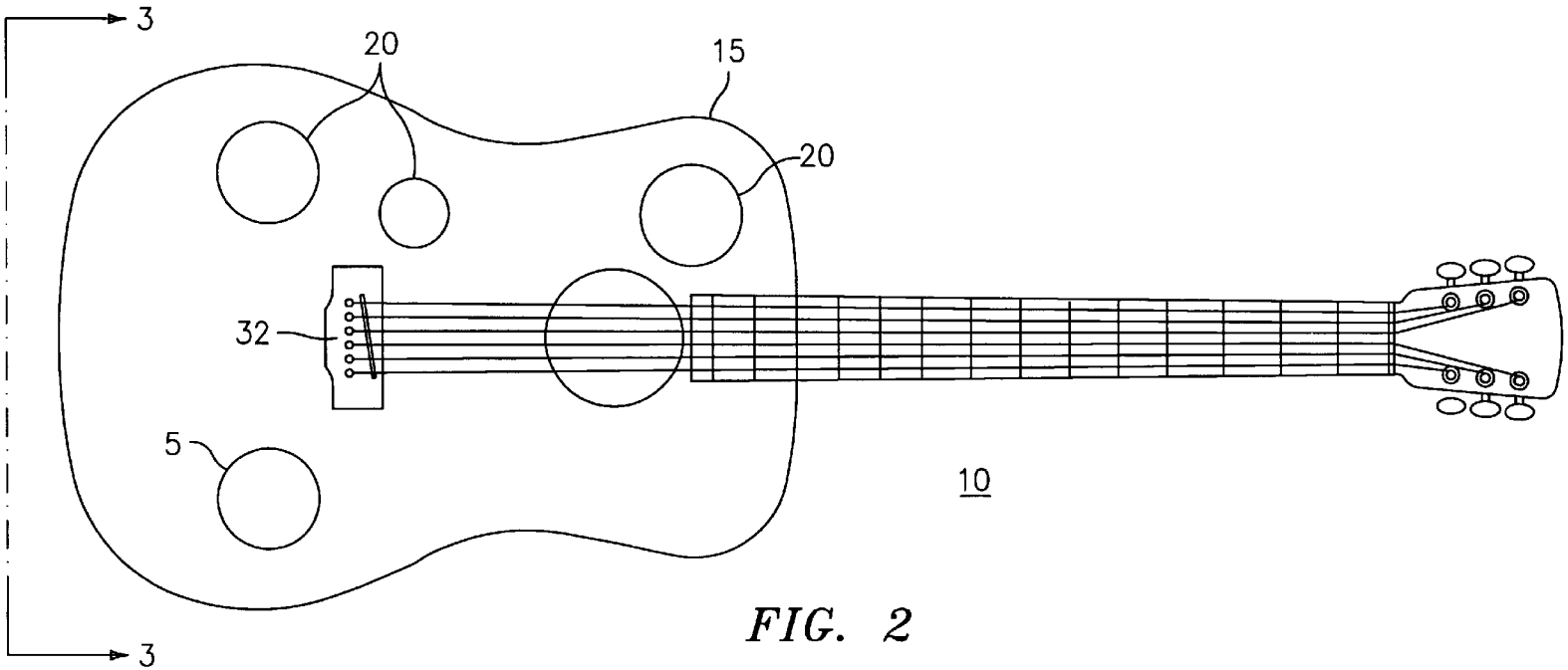
FIG. 2 is a diagram of a guitar with percussion additions affixed to the some of the off-set sound holes.

FIG. 2 shows the guitar of FIG. 1 having percussion additions 20 affixed to selected off-set sound holes 5 in the body 15 of the guitar 10. While sound holes are shown on the soundboard of the body of the guitar, holes may be added to any surface of the guitar body, including the top, sides, back or bottom.

Preferably, the percussion additions are fitted into select off-set hole in the body of the stringed musical instrument, such as a guitar. The percussion additions may be designed with supports having diameters approximately equal to the sound holes so that they may remain in place by way of friction. Alternatively, the percussion additions may be threaded to screw into a base that is fitted into sound holes in the body of the guitar or may be snapped into suitably designed bases. While guitars with existing off-set sound holes are most preferred, off-set sound holes may be added to any surface of the body of the guitar for the purpose of receiving the percussion additions. In a less preferred embodiment, the off-set sound holes are F-sound holes in the body of the stringed musical instrument, such as a guitar, violin or other stringed musical instrument. The percussion additions may be played in conjunction with strumming, flatpicking, or finger picking the guitar or may be played separately.

Figure 3:
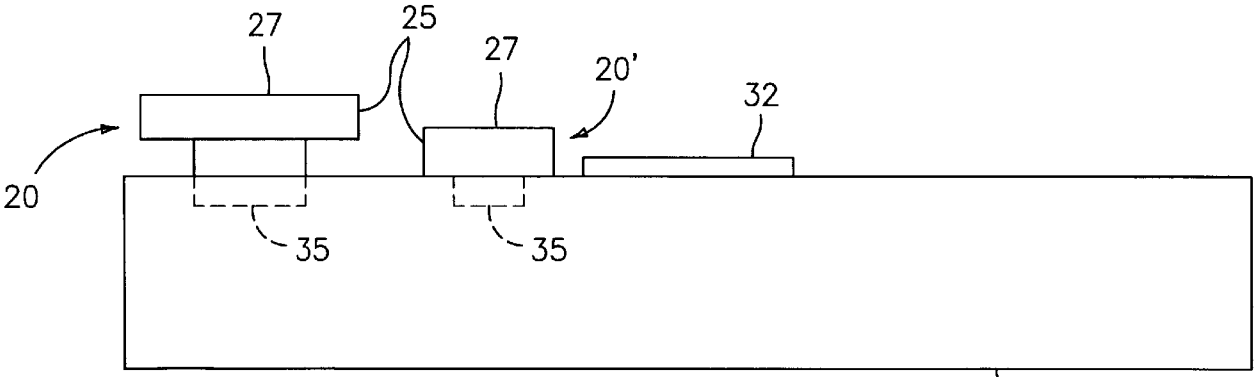
FIG. 3 is a side view of the guitar with percussion additions as viewed along 3—3.

FIG. 3 is a side view of the guitar of FIG. 2 showing the elevation of percussion additions when affixed to the body 15 of the guitar as viewed along line 3—3; as a point of reference, the bridge 32 is identified in this figure. More particularly, this figure depicts the guitar body 15, with two percussion additions 20 and 20' affixed to two of the off-set sound holes. The number of percussion additions and the location of percussion additions are decisions of the musician and lack criticality. Each percussion addition has a hollow disc 25 with a face or drumhead 27 and a hollow support 35. The support 35 may be completely inserted into the off-set sound hole so that the disc is flush with the body as shown by percussion addition 20'. Alternatively, the support 35 may be partially inserted so that a portion of the support 35 is within the body 15 of the guitar 10 and the disc is elevated from the body 15 of the guitar 10 as shown by percussion addition 20.

Figure 4:
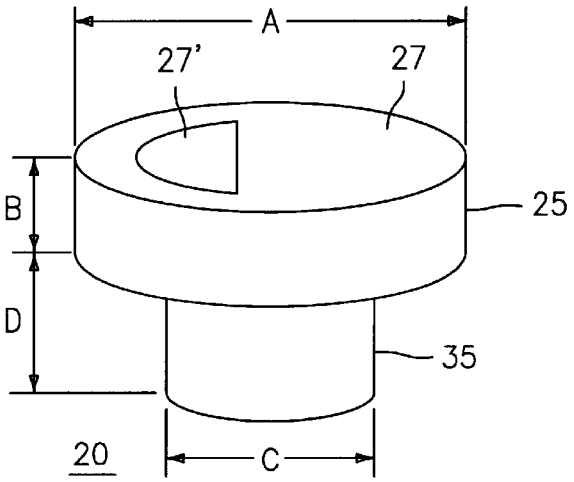
FIG. 4 is a detailed diagram of a percussion addition.
Figure 5:
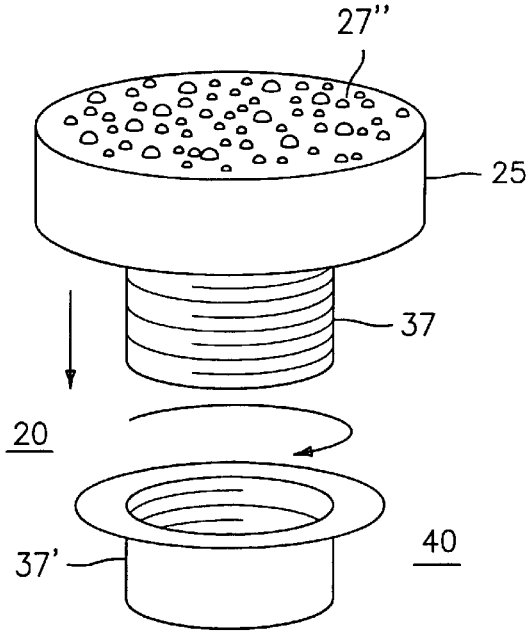
FIG. 5 is a detailed diagram of a percussion addition showing a threaded attachment.

FIG. 4 is a detail of a percussion addition 20. The percussion addition 20 is a disc 25 with a face 27 and a support 35. The percussion addition may be made of any material desired by the musician. One skilled in the art would recognize that different materials created different sounds. While wood, specifically mahogany or walnut, is preferred, additional acceptable materials include but are not limited to various metals, carbon graphite, plastics, fiberglasses, and other woods. Further, the disc may be constructed analogous to a conventional drum. The face 27 may be unitary or may have one or more separate percussion material insets 27' or some combination thereof. The face 27 or inset 27' may be made of different materials to create different sounds, such as different metals such as brass and aluminum and different woods, such as birch, plywood, mahogany or walnut. Insets may also be plastic, fiberglass or cloth, depending on the sound desired by the musician. Most preferably, the diameter of the inset is substantially equal to the diameter of the face such that the face consists nearly entirely of the inset (not shown). Alternatively, the inset may comprise only a portion of the face so that the face is made of more than one material to create a variegated percussion sound. Further, as shown in FIG. 5 the face 27 may be textured to create varying percussion sounds. The texture may include nubs 27" or may be ribbed or include textures as preferred by the musician.

The face 27 of the disc 25 may be flat or bowed to create differing percussion sound based on the preferences of the musician. The shape of the face 27 is not critical.

The discs of the percussion additions may be of varying sizes and of varying materials. One skilled in the art would recognize that different dimensions and different materials (diameter as well as depth) create different sounds and should be chosen accordingly. The percussion additions are characterized by the following dimensions as shown in FIG. 4: (1) disc outer diameter (A), (2) disc outer height (B), (3) support outer diameter (C), and (4) support height (D). Four preferred percussion additions have the following dimensions:

| | Disc Outer Diameter (A) | Disc Height (B) | Support Outer Diameter (C) | Support Height (D) |
|---|---|---|---|---|
| 1 | 3⅞ | ⅜ | 1½ | ¼ |
| 2 | 2 7/16 | ⅜ | 1½ | ¼ |
| 3 | 2 7/16 | ⅜ | 1⅛ | ¼ |
| 4 | 2 3/16 | ⅜ | 1⅛ | ¼ |

All dimensions are in inches.

The particular disc outer diameter, disc height and support height dimensions and shape were selected based on sound and aesthetic preferences. While preferable ranges for the dimensions are A equal to approximately 2–4½ inches, B equal to approximately ¼ to ¾ inches, and D equal to ⅛–½ inches, other dimensions may be suitably employed according to the musicians preferences. The outer diameter of the support (C) was selected so that the support may fit directly into the off-set sound holes of an OVATION® Celebrity Deluxe guitar (which has ⅜, ½, ⅝, 1⅛, and 1½ inch diameters holes) and remain in place by way of friction; other support outer diameters may be suitably employed. In the preferred embodiment, the disc outer diameter is larger than the support outer diameter. In addition, other shapes may be used to create other sounds and/or for aesthetic reasons.

The support height was selected to minimize obstruction of the instrument body and allow the disc to lie flat on the soundboard (or other surface) of the instrument body. It is not necessary that the disc lie flat on the soundboard of the instrument; the disc may be elevated above the soundboard of the instrument body. Preferably, the distance between the disc and the soundboard of the instrument body is less than 1½ inches. Therefore different support heights may be chosen for sound or aesthetic purposes as well as to fit other existing or custom made sound holes.

Figure 6:
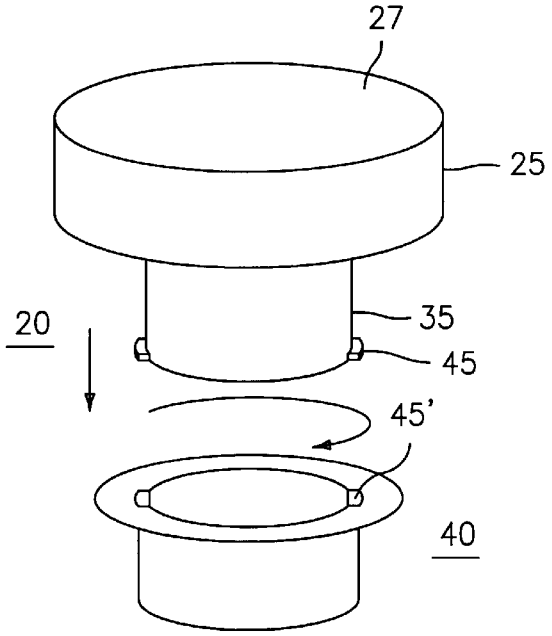
FIG. 6 is a detailed diagram of a percussion addition showing a snapping attachment.
Figure 6A:
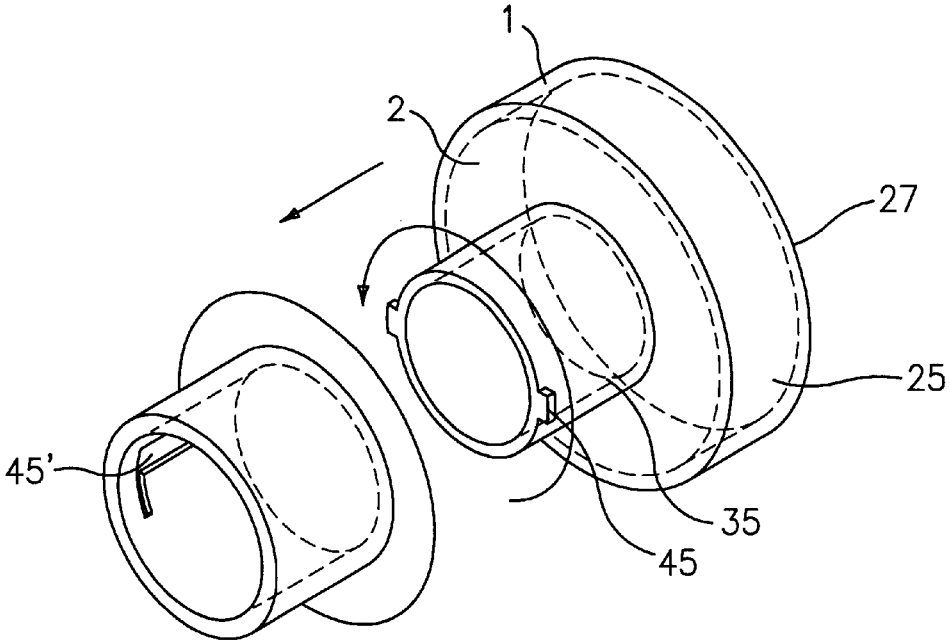
FIG. 6*a* is a detailed diagram of the percussion addition of FIG. 6 showing that the addition and base are hollow.

As stated above, the disc and support of the percussion addition are hollow to allow the creation and development of percussion sound. As shown in FIG. 6*a,* the disc has a face 27 side walls 1 and lip 2 defining a disc hollow cavity with an opening in the lip, preferably in the center of the lip. The support 35 is a hollow cylinder or other desired shape such that the ends have openings defining a support hollow cavity. Preferably, these openings have diameters substantially equal to the support outer diameter, less the cylinder's wall thickness. The opening of the lip of the disc corresponds with one of the end openings of the support so that the disc hollow cavity communicates with the support hollow cavity. Thus, the hollow disc and the hollow support form a continuous hollow space. This continuous hollow space allows percussion sound to resonate and develop in the percussion addition.

The disc and support may be of unitary construction. Alternatively, the support and disc may be threaded so that the disc may screw onto the support. Such a construction would allow various discs to be interchangeable with a single support. Such a connection is preferably designed to minimize obstruction of the disc hollow cavity by the support's walls. Obstruction of the disc hollow cavity may result in undesired percussion sound dampening.

One skilled in the art would recognize that the thickness of the disc face (or drumhead) may be adapted to create different sound characteristics and may be selected accordingly.

While the embodiment shown has a circular disc, any shape disc, such as rectangular, triangular, or octagonal, may be used and is not critical to the invention. Thus, the term disc is intended to refer to the structural component that is impacted to create a percussion sound and is not intended to limit the claims to specific dimensions or shapes.

As stated above, the support 35 of the percussion addition 20 may be designed to have a diameter approximately equal to that of its corresponding off-set sound hole such that the support may slide into the off-set sound hole and remain in place based solely on friction. Alternatively, the addition 20 may slide into a base 40, as shown in FIGS. 5 and 6, which is placed into the off-set hole. The support 35 may be threaded 37 so as to match threads 37' of the base 40 as shown in FIG. 5.

Alternatively, as shown in FIG. 6, the support 35 may have one or more tabs 45 that correspond to channels 45' in the base. The support may be placed into the base 40 so that the tabs 45 align with the channels 45'. The base of the addition is longer than the depth of the base so that the addition can be twisted to lock into place.

Figure 7:
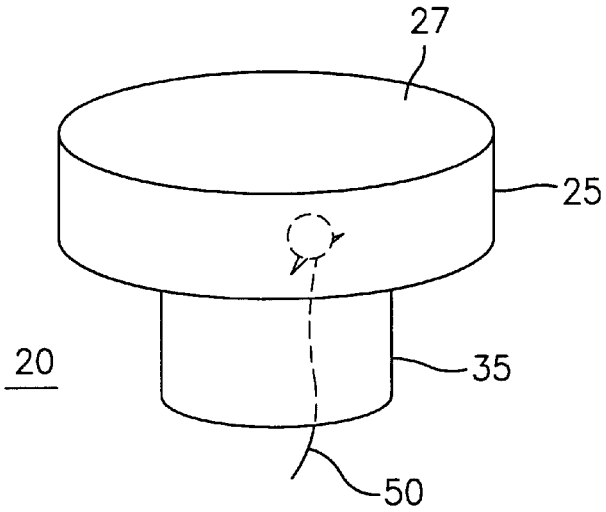
FIG. 7 is a detailed diagram of a percussion addition showing an amplification device.

To create percussion sound, the disc and support are both preferably hollow as shown in FIG. 6A. Preferably, as shown in FIG. 7 an amplification device 50 such as a microphone or contact pick-up may be added to the percussion addition. Other amplification devices may be suitably employed; microphones and contact pick-ups are provided as examples of preferred amplification devices. Preferably, the amplification device 50 is be placed inside the disc of the percussion addition and each percussion addition contains its own amplification device. One skilled in the art would understand the limitations of each device. More specifically, while contact pick-ups may create a preferable sound, they are not easily interchanged during performances. Therefore, in some instances a musician may prefer a contact pick-up while in other instances a microphone may be preferred. The amplification devices may be electronically connected via the jacks 30 shown in FIG. 1.

A preferable microphone includes, an Acoustic GHS 001 Soundhole Microphone (Model #AI37) manufactured by GHS Corporation of Battle Creek, Mich. as they have long flexible wire leads that allow definitive placement of the microphones within the instrument body and inside the disc of the percussion addition. Preferably, the microphone includes a wind screen.

In one embodiment of the present invention, percussion additions are provided as a kit. Such a kit would provide more than one different percussion addition to allow a musician to interchange different percussion additions to create a variety of percussion sound during performances. The percussion additions are preferably made of different materials or textures to provide different percussion sounds. Alternatively, such a kit could include at least one percussion addition that is manufactured so that the disc is removable from its support. Additional discs, each made of a different material is provided so that the discs may be interchanged with the removable disc and connect to the common support. Such a kit would allow the musician to create a different percussion sound with the same support by merely interchanging one disc for another. These kits may also include one or more amplification devices for assembly onto a guitar or other stringed musical instrument. The kit may also include bases for attaching the discs to the stringed musical instrument. In addition, the kit could include a guitar with off-set sound holes specially drilled for the purposes of receiving the percussion additions.

In another embodiment, the present invention is a combination stringed and percussion instrument having percussion additions affixed to one or more sound holes of the stringed instrument. Ideally, the stringed instrument is a guitar having off-set sound holes and one or more percussion additions are affixed to one or more off-set sound holes, including F-sound holes. The percussion additions may be affixed to the sound holes or may be unitary or integral with the guitars, or stringed instrument's body. Amplification devices commonly used in the art may be placed in the disc of the percussion addition.

A further embodiment of the present invention is a musical composition that is played on a stringed musical instrument employing at least one percussion addition as described above. Such a composition would require that stringed music be accompanied by percussion music on the same instrument.

While the invention has been described above with reference to specific embodiments thereof, it is apparent that many changes, modification, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A percussion addition for a stringed instrument comprised of a hollow disc with a face, wherein said disc has a hollow support such that said hollow disc and said hollow support form a continuous hollow space and wherein said support is adapted for connection to an off-set sound hole in a stringed instrument.

2. The percussion addition of claim 1, wherein said face is bowed.

3. The percussion addition of claim 1, wherein said disc is circular.

4. The percussion addition of claim 1, wherein said hollow support is integral with said hollow disc.

5. The percussion addition of claim 1, wherein said hollow support is threadedly attached to said hollow disc.

6. The percussion addition of claim 1, wherein the disc has an outer diameter larger than the outer diameter of the support.

7. The percussion addition of claim 6, further comprised of a threaded base, wherein said threaded base is sized to affix to said off-set sound hole and wherein said support is threaded for connection to said threaded base.

8. The percussion addition of claim 1, wherein said support is adapted for connection to an F-sound hole.

9. The percussion addition of claim 1, wherein said face of said disc has a textured surface.

10. The percussion addition of claim 1, wherein said face of said disc is comprised of at least one inset that has a diameter approximately equal to the diameter of said face.

11. The percussion addition of claim 10, wherein at least one of said insets is made of metal.

12. The percussion addition of claim 11, wherein at least one of said insets is made of wood.

13. A percussion addition kit comprised of more than one percussion addition, wherein each percussion addition has a different percussion sound so that a musician can interchange percussion additions on a stringed instrument to create a variety of percussion additions and wherein said percussion additions are comprised of a hollow disc with a face, wherein said disc has a hollow support such that said hollow disc and said hollow support form a continuous hollow space and wherein said support is adapted for connection to selected off-set sound holes in a stringed musical instrument.

14. The percussion addition kit of claim 13, further comprised of one or more amplification devices.

15. A percussion addition kit comprised of more than one percussion addition, wherein each percussion addition has a different percussion sound so that a musician can interchange percussion additions on an offset sound hole in a stringed instrument to create a variety of said percussion additions and wherein said percussion additions are comprised of a hollow disc with a face, wherein said disc has a hollow support such that said hollow disc and said hollow support form a continuous hollow space and wherein said hollow disc is removable from said hollow support, and wherein said kit further includes one or more different discs interchangeable with said removable disc.

16. The percussion addition kit of claim 15, further comprised of one or more amplification devices.

17. A combination stringed and percussion instrument comprised of a stringed instrument with one or more off-set sound holes and one or more percussion additions of affixed to selected of said one or more off-set sound holes said additions comprising a hollow disc with a face, wherein said disc has a hollow support such that said hollow disc and said hollow support form a continuous hollow space.

18. The combination stringed and percussion instrument of claim 17, wherein said stringed instrument is a hollow bodied guitar.

19. The combination stringed and percussion instrument of claim 17, wherein said one or more off-set sound holes are F-sound holes.

20. The combination stringed instrument and percussion instrument of claim 18, further comprised of one or more amplification devices positioned in said discs.

* * * * *